US006405906B1

(12) United States Patent
de Laforcade

(10) Patent No.: US 6,405,906 B1
(45) Date of Patent: Jun. 18, 2002

(54) DEVICE AND METHOD FOR DISPENSING A PRODUCT ON A PRODUCT SAMPLER

(75) Inventor: Vincent de Laforcade, Rambouillet (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 09/899,180

(22) Filed: Jul. 6, 2001

(30) Foreign Application Priority Data

Jul. 7, 2000 (FR) ..... 00 08915

(51) Int. Cl.[7] ..... B65D 88/54
(52) U.S. Cl. ..... 222/321.8; 222/153.13
(58) Field of Search ..... 222/153.13, 321.8, 222/402.1, 402.13, 402.14, 402.15, 509, 518

(56) References Cited

U.S. PATENT DOCUMENTS 3,305,144 A 2/1967 Beres et al.
3,756,512 A * 9/1973 Dyal ..... 222/402.13
4,682,713 A * 7/1987 Clapp ..... 222/153.13
5,110,231 A * 5/1992 Monteith et al. ..... 222/402.15
5,992,708 A 11/1999 Gaichuk
6,003,740 A 12/1999 Castaneda, Jr.

FOREIGN PATENT DOCUMENTS

FR 2 060 181 6/1971

* cited by examiner

*Primary Examiner*—William C. Doerrler
*Assistant Examiner*—Thach H. Bui
(74) *Attorney, Agent, or Firm*—Finnegan, Henderson, Farabow, Garrett & Dunner, L.L.P.

(57) ABSTRACT

A device for dispensing a product onto a product sampler may comprise a dispensing member configured to be connected to a product receptacle and at least one outlet orifice in flow communication with the dispensing member. The device may also comprise an actuator element configured to actuate the dispensing member and a locking element. The locking element may have a first position in which the dispensing member cannot be actuated and a second position in which the dispensing member can be actuated. Additionally, the locking element may move from the first position to the second position when the product sampler is placed in front of the at least one outlet orifice.

107 Claims, 7 Drawing Sheets

DEVICE AND METHOD FOR DISPENSING A PRODUCT ON A PRODUCT SAMPLER

The present invention relates to a device for dispensing a product. In particular, the present invention relates to a device for dispensing a product onto a product sampler. Such a device could be used at points of sale, for instance, to test products such as perfumes.

In the perfumery sector of store, testers are frequently set up at the points of sale of the products to allow customers to try the product before buying it. These testers are usually the same models or product receptacles as those intended for sale. The limited volume of these testers means that they have to be renewed at frequent intervals. Furthermore, it can be difficult for customers to judge perfumes properly in an atmosphere laden with the blended vapors of the different perfumes that are present at the testing point. Also, the disappearance of testers from these test points is not uncommon. Lastly, the creativity of the designers of such points of sale is limited by having to find a very specific location at the front for the tester or testers.

Devices are known wherein a push-button pump is located separately from a receptacle containing a perfume. Hence the pump, with its associated actuating device, can be mounted in a fixed position on a display unit and connected via a supply line to the receptacle containing the perfume. The receptacle will generally be situated in a cabinet not accessible to the customers. The supply line between the pump and the receptacle will generally be relatively long. The risk of theft or of breakage of the bottles of perfume may be reduced. In addition, the amount of required display space also may be reduced. The receptacles containing the perfumes can be of larger capacity. The vapors released from the bottles are confined in a closed cabinet.

However, the cost of the cabinet may be significant. Additionally, the pushbutton, which is provided to actuate the pump, is frequently pulled out, often out of pure vandalism, rendering the test device unusable.

Other devices have been proposed for the automatic impregnation of product samplers, typically made of cardboard and sometimes known as "slips." These product samplers are offered to the consumer on a display unit, so that the consumer can impregnate the product sampler on demand with the desired perfume product.

For instance, in one device, the consumer inserts the product sampler into a horizontal slot. The slot is defined in part by an eccentric notched wheel. During insertion and due to friction, the product sampler causes the eccentric notched wheel to turn. The product sampler stops at the end of its travel against an end stop. The product sampler is retained in the slot by the eccentricity of the wheel. The consumer then withdraws the product sampler. The act of pulling on the retained product sampler actuates the pump and releases the product onto the product sampler. As the impregnated product sampler continues to be pulled, it is released by a clutch mechanism.

Besides the sophistication of this device, such a device is expensive to manufacture, unreliable, and not directly operated by the consumer. Specifically, the mechanical pulling force intended to actuate the pump is exerted on the impregnated product sampler. The product sampler, especially if it has already been impregnated before, is liable to tear when pulled by the consumer. Part of the product sampler may be left jammed inside the device, possibly preventing further operation. Furthermore, if the product sampler to be impregnated is not very stiff, it will be difficult to insert into the slot defined by the notched wheel.

One optional aspect of the invention relates to a device for dispensing a product onto a product sampler that is mechanically actuated.

Another optional aspect of the invention relates to a device for dispensing product onto a product sampler that will be simple to use, inexpensive to produce, mechanically reliable, and sufficiently robust to withstand acts of vandalism.

It should be understood that the invention could still be practiced without performing one or more of the optional aspects described above. Still other optional aspects will become apparent from the detailed description that follows.

As broadly described herein, the present invention relates to a device for dispensing a product onto a product sampler. The device may comprise a dispensing member configured to be connected to a product receptacle and at least one outlet orifice in flow communication with the dispensing member. The device may also comprise an actuator element configured to actuate the dispensing member and a locking element. The locking element may have a first position in which the dispensing member cannot be actuated and a second position in which the dispensing member can be actuated. Additionally, the locking element may be configured to move from the first position to the second position when the product sampler is placed in front of the at least one outlet orifice.

The device may be placed in an enclosure or behind a wall in such a manner that only a portion of the actuator element is accessible from outside the enclosure or wall. For instance, a window or opening in the wall or one face of the enclosure may allow the consumer to indirectly place the product sampler in front of the outlet orifice. The risk of acts of vandalism may thus be limited. Also, because the dispensing member may not be actuated without first placing a product sampler in front of the outlet orifice, product may not be dispensed unless a product sampler is in place. This may reduce the risk of fouling the device.

The enclosure or the wall may form a fixed body (or frame) on which the dispensing member may be mounted, optionally in a fixed position. The actuator element and the locking element may be movable with respect to the fixed body and with respect to the dispensing member. The device optionally comprises a receiving member for receiving the product sampler and enabling placing of the product sampler in front of the at least one outlet orifice. Such a receiving member may be in the form of a plate. The receiving member may allow the product sampler to be placed, for example, at a fixed distance or at a fixed lateral position with respect to the outlet orifice. Thus, it may be possible, for instance, when the product is dispensed in the form of a conical spray, to ensure that all of the product dispensed is deposited on the product sampler.

Optionally, the product sampler is placed with respect to the outlet orifice by a movement, for example, a translational movement, of the product sampler with respect to the receiving member. The locking element may be moved from the first position to the second position in response to movement of the product sampler. In the course of this movement, the stress on the product sampler may be insignificant, thereby reducing the risk of damage to the product sampler, particularly where the product sampler is made of card stock.

Alternatively, the product sampler may be placed with respect to the outlet orifice by a movement of the receiving member itself. In this case, the product sampler to be impregnated may have first been placed on the receiving member.

Optionally, the receiving member may act as the actuator element that actuates the dispensing member. This may reduce the number of parts outside of the enclosure or wall and correspondingly may reduce the risk of vandalism.

Alternatively, an actuator element separate from the receiving member may be provided. For instance, this separate actuator element may be in the form of a button.

Optionally, the product sampler may be used in conjunction with the receiving member to actuate the dispensing member. For instance, the movement of the product sampler, as it is placed in front of the outlet orifice, may end with a joint or mutual movement of the product sampler and of the receiving member. This mutual movement may occur over a short distance, which corresponds to the actuation stroke of the dispensing member. Such a mutual movement may be of negligible amplitude compared with the movement of the product sampler relative to the receiving member.

Also, the actuation of the dispensing member may be the result of a force applied manually to the actuator element. This force may be applied approximately along an axis defined by a direction of movement of the product sampler with respect to the receiving member. Thus, the manual movement may be simplified because the manual actuating movement is a continuation of the movement for placing the product sampler in front of the outlet orifice. The whole operation may be done with one hand.

The receiving member may comprise a plate having a guide element capable of guiding the product sampler in translational movement. Such a guide element may be formed, for example, from the edges of an indentation in the surface of the plate. The product sampler, which is to be impregnated, may be slidably inserted within the edges of the indentation. Alternatively, guide elements may be formed by continuous or discontinuous channels or raised ridges.

Optionally, a stop (e.g., a stop surface) may be provided to limit the movement of the product sampler with respect to the receiving member. This may ensure that the axial placing of the product sampler with respect to the outlet orifice is controlled and is substantially identical for all product samplers to be impregnated. In addition, such a stop may indicate to the user the proper moment at which to actuate the dispensing member. The stop, similar to the guide element, may be formed from an edge in an indentation of the surface of the plate forming the receiving member. Alternatively, the stop may be formed of one or more raised elements.

In one optional embodiment, the mechanical locking element comprises a catch. The catch may come into engagement with a dispensing head when the locking element is in a first position. The dispensing head may comprise the outlet orifice. In the first position, the locking element may prevent actuation of the dispensing member. The catch may be coupled to a pin. One end of the pin may be situated on the path of the product sampler to be impregnated. The product sampler may come into engagement with the pin during the placing of the product sampler with respect to the outlet orifice. The engagement of the pin with the product sampler may cause the catch to move the locking element to the second position.

The movement of the catch may be a pivoting movement, for example, movement about a first pivot axis (X). The product sampler may slide along the receiving member, and one end of the product sampler may come into engagement with the pin, making the pin pivot and causing a corresponding pivoting movement of the catch. The product sampler then may pass underneath an end of the pin. The positioning of the product sampler beneath the end of the pin may prevent the catch from returning to the locked position. So long as the product sampler to be impregnated is in position with respect to the outlet orifice, the pin may remain pivoted, thereby preventing the catch from returning to the locked position.

Optionally, the first pivot axis (X) may be perpendicular to a longitudinal axis (Y) of the dispensing member, and perpendicular to the axis (A) defined by the direction of the movement of the product sampler with respect to the receiving member.

The first pivot axis (X) may be at approximately the same height as a portion of the dispensing head that comes into engagement with the catch when the locking element is in the first position. This height may, for instance, be measured as the distance from the point of engagement of the catch with the portion of the dispensing head to the longitudinal axis (Y) of the dispensing member. Thus, the operation of the locking element may be improved. In particular, the force applied by the product sampler to be impregnated on the pin, which causes the catch to swing away or pivot, may be noticeably reduced. This reduced force may reduce the risk of damage to the product sampler.

In another optional embodiment, the locking element may automatically return to the first position, for instance, under gravity, when the product sampler is no longer in engagement with the pin.

Actuation of the dispensing member may be by axial movement of an actuating member of the dispensing member, for instance, of a pump rod, along the longitudinal axis (Y) of the dispensing member. In the case of a dispensing member having a valve connected to an aerosol receptacle, the valve may be actuated by axial depression or by lateral tilting of the actuating member, for instance, a valve stem.

The actuator element may be able to pivot about a second pivot axis (Z) perpendicular to the longitudinal axis (Y) of the dispensing member. Such a second pivot axis (Z) may be perpendicular to the axis (A) defined by the direction of the movement of the product sampler with respect to the receiving member. The distance between the second pivot axis (Z) and the receiving member may be sufficiently large compared with the actuating stroke of the dispensing member such that the movement of the receiving member may be substantially linear, and optionally, approximately in line with the movement of the product sampler with respect to the receiving member.

Also, optionally, the actuator element may come into engagement during its pivoting movement about the second pivot axis (Z) with a bearing surface on the dispensing head. The engagement of the actuator element and of the bearing surface of the dispensing head may take place via a portion of the bearing surface. The bearing surface of the dispensing head and/or the corresponding portion of the actuator element may have, for instance, a conical profile, a cylindrical profile or a spherical profile.

Optionally, an anti-rotation device may be provided to substantially prevent the dispensing head from rotating about the longitudinal axis of the dispensing member. The anti-rotation device may be slidably coupled to the dispensing head and may translationally guide the dispensing head when engaged with the actuator element in response to an actuating command.

According to another aspect, the invention may relate to a device comprising a dispensing member capable of being actuated and configured to be connected to a product receptacle. A dispensing head may be movably coupled to the dispensing member and have at least one outlet orifice. An actuator element may be configured to engage the dispensing head. A locking element may have a first position engaged with the dispensing head and a second position disengaged from the dispensing head. Optionally, the dispensing member cannot be actuated with the locking element in the first position and can be actuated with the locking element in the second position. The locking element may be configured to move from the first position to the second position when the product sampler is moved relative to the dispensing member.

According to an optional embodiment, a system for dispensing a product onto a product sampler is provided. The system may comprise a device for dispensing a product onto a product sampler and a product receptacle in flow communication with the device. The product receptacle may contain a product (e.g., a perfume).

According to another optional embodiment, a system may comprise a device for dispensing a product onto a product sampler and an enclosure for substantially containing the device. A passage through a wall of the enclosure may allow the product sampler to be placed with respect to the outlet orifice. The actuator element may be accessible from outside the enclosure. Alternatively, all the components of the device may be located behind a wall of a display unit.

Optionally, the receiving member extends at least partly out of the enclosure via the passage. The dispensing member may then be actuated in response to a pressure applied to the receiving member.

The dispensing member may be coupled to the product receptacle via a product supply line having a first end and a second end. The first end may be inside the enclosure. The second end of the supply line may be located outside of the enclosure and configured to connect to the product receptacle.

The device according to the invention may be particularly suitable for dispensing a cosmetic product, for example, a perfume product.

According to another optional aspect, the invention may include a method for dispensing a product onto a product sampler. The method may comprise providing the system for dispensing a product onto a product sampler, providing the product sampler, wherein at least a part of the product sampler is placed in front of the at least one outlet orifice, and providing the product, wherein the product is dispensed onto the product sampler.

According to yet another optional aspect, a method may comprise placing at least a part of the product sampler in front of the at least one outlet orifice of the system for dispensing a product onto a product sampler, and dispensing the product onto the product sampler.

In one optional embodiment, the method may comprise actuating the dispensing member when at least a part of the product sampler is placed in front of the outlet orifice.

Optionally, the actuator element may comprise a receiving member configured to hold the product sampler, and the placing of the product sampler may comprise moving the product sampler with respect to a receiving member to enable the placing of at least a part of the product sampler in front of the at least one outlet orifice.

The actuating of the dispensing member may comprise applying a manual force to the actuator element. The manual force may be applied approximately along an axis defined by a direction of movement of the product sampler with respect to the receiving member.

The method may further comprise guiding the product sampler with a guide element of the receiving member and stopping movement of the product sampler with respect to the receiving member when the product sampler contacts a stop of the receiving member.

The locking element may comprise a catch configured to engage a portion of the dispensing head to prevent actuation of the dispensing member when the locking element is in the first position and to be disengaged from the dispensing head to allow actuation of the dispensing member when the locking element is in the second position. The method may comprise moving the locking element from the first position to the second position.

Optionally, the locking element may comprise a pin coupled to the catch, and the placing of the product sampler may comprise engaging the product sampler with the pin to move the locking element from the first position to the second position.

In one optional embodiment, the moving of the locking element may comprise pivoting the catch about a first pivot axis, the first pivot axis being substantially perpendicular to a longitudinal axis of the dispensing member.

Also, the locking element may automatically return to the first position when the product sampler is disengaged from the pin, and the method may further comprise disengaging the product sampler from the pin.

Optionally, moving the locking element from the first position to the second position may comprise pivoting the actuator element about a second pivot axis perpendicular to a longitudinal axis of the dispensing member.

The dispensing head may comprise a bearing surface, and the pivoting of the actuator element about the second pivot axis may comprise engaging the actuator element with the bearing surface.

Besides the structural arrangements and procedural aspects described above, there could include a number of other arrangements, such as those explained hereinafter. It is to be understood that both the foregoing description and the following description are exemplary.

The accompanying drawings are incorporated in and constitute a part of this specification. The drawings illustrate optional embodiments of the invention. In the drawings.

Reference will now be made in detail to optional embodiments of the invention, examples of which are illustrated in the accompanying drawings. Whenever possible, the same reference numbers are used in the drawings and the description to refer to the same or like parts.

Figure 1:
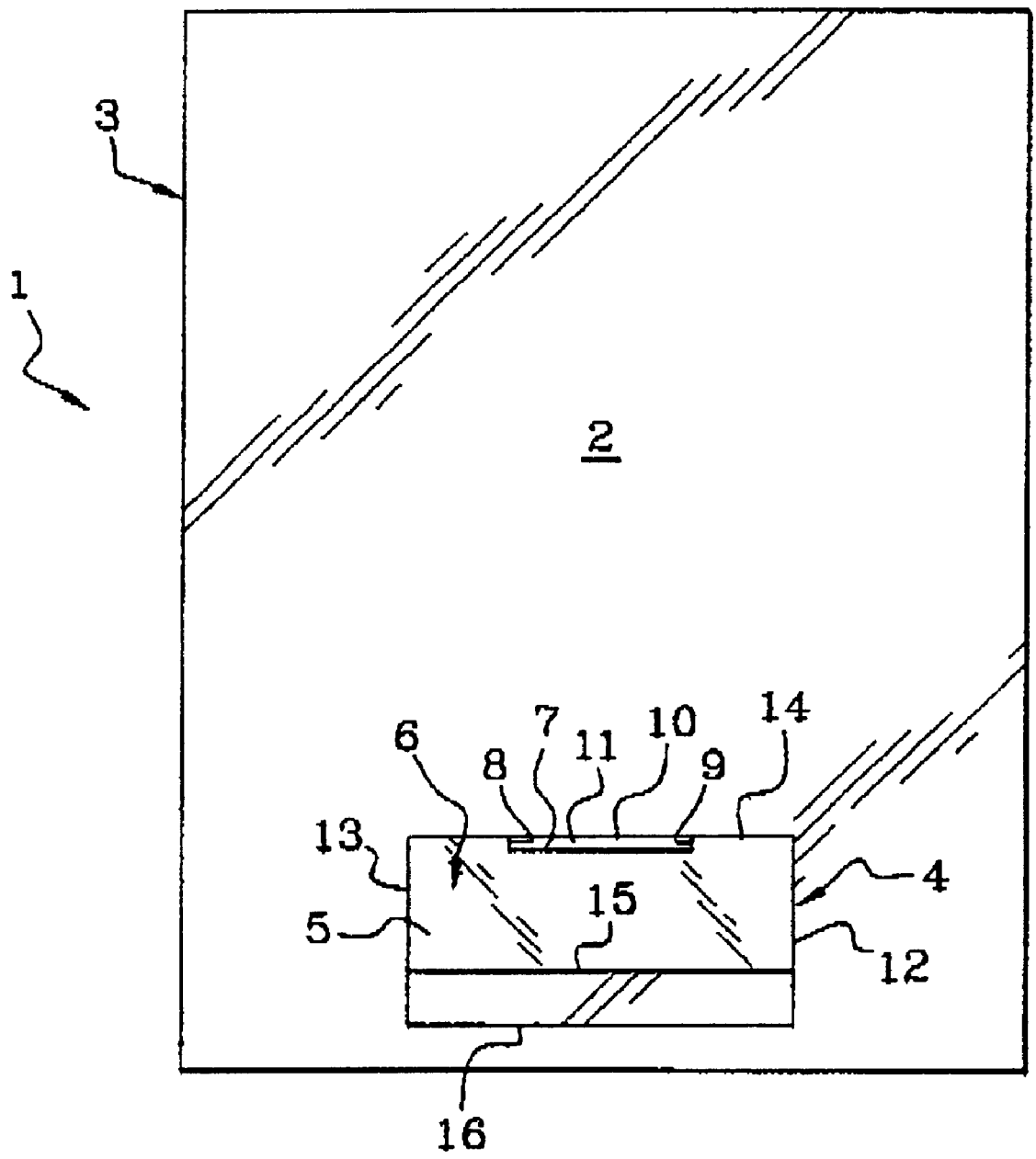
FIG. 1 is a front view of an embodiment of a device for dispensing a product onto a product sampler.

Referring to FIG. 1, a device according to an optional embodiment of the invention is depicted. The front face 2 of a parallelepipedal enclosure 3 forms part of the device 1. A window 4 may pass through the front face 2 in the vicinity of its lower edge, and the front end 5 of a receiving member or plate 6 designed to take the sample to be impregnated may project through the window 4. The upper surface 14 of the receiving member 6 comprises an axial indentation 7 bounded by two longitudinal edges 8, 9. The indentation 7 may define, in conjunction with the upper edge 10 of the window 4, a slot 11 for insertion of the product sampler into the device. The side edges 12, 13 of the window 4 may help to guide the receiving member 6 when the receiving member 6 is used to actuate the pump. The lower surface 15 of the receiving member 6 is at a distance from the lower edge 16 of the window 4. This can allow for a pivoting movement of the receiving member 6 about an axis perpendicular to the axis of the receiving member 6, so as to actuate the pump.

Figure 2:
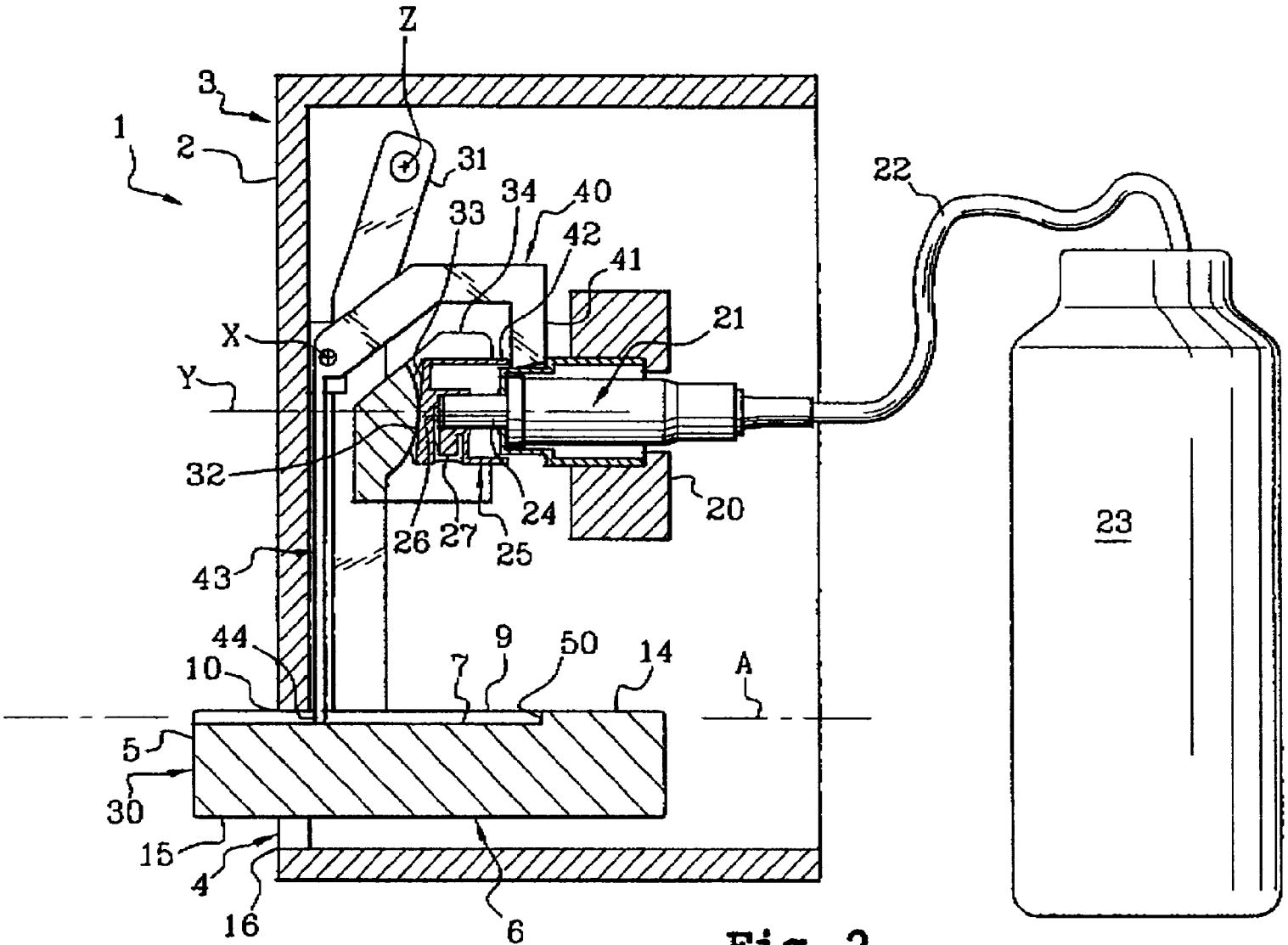
FIG. 2 is a cross-section of an embodiment of a system for dispensing a product onto a product sampler.

Referring to FIG. 2, the device 1 may comprise an enclosure 3, one face of which, opposite the front face 2, is open. The device 1 may also comprise a fixed support 20 on which a pump 21 is mounted in such a way that it cannot move. The pump 21 may be connected to one end of a product supply line 22, the other end of which may be connected to a product receptacle 23, optionally made of glass or metal, and containing the product (e.g., perfume) to be dispensed. The product receptacle 23 may be outside of the enclosure. The pump 21 may comprise a pump rod 24 with a dispensing head 25, for example, in the form of a push-button force-fitted onto the pump rod. The dispensing head 25 may have a channel 26 in communication with the pump rod 24 and leading to an outlet orifice 27 formed in a nozzle and pointing in the direction of the axis A of the receiving member 6.

Figure 4A:
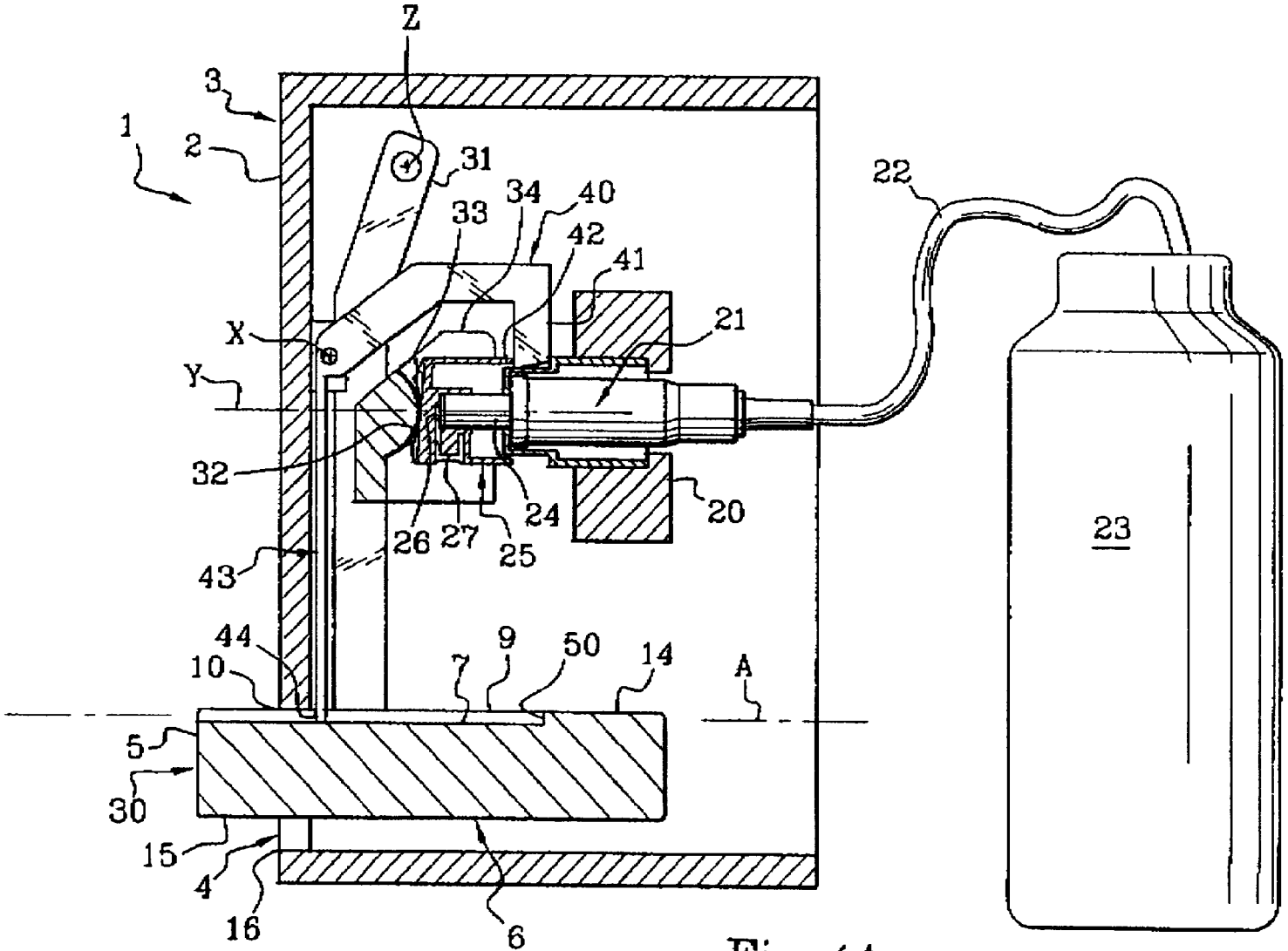
FIGS. 4A and 4B are cross-sections of alternative embodiments of a system for dispensing a product onto a product sampler.
Figure 4B:
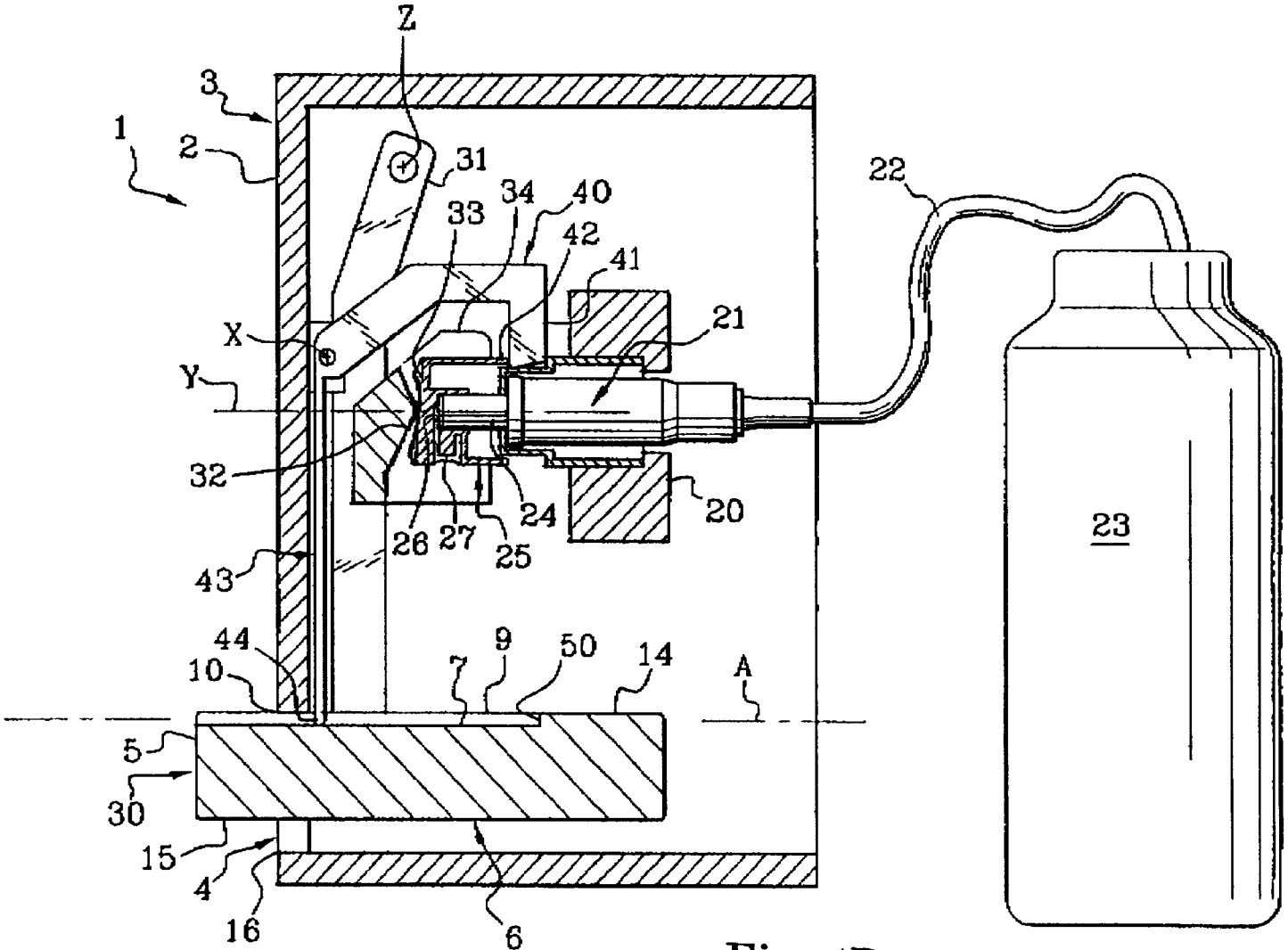

The dispensing head 25 may be prevented from rotating about its axis Y by two plates 34 on an actuator element 30. The actuation element 30 may comprise the receiving member 6, whose front face 5 may extend out of the enclosure 3 through the window 4. The receiving member 6 may be integral with one end of two arms 31 which may be spaced apart and parallel with each other. At the other end, the arms 31 may pivot on a spindle of axis Z connected to the enclosure 3. The axis Z may be perpendicular to the axis Y of the dispensing head 25, and also may be perpendicular to the axis A of the receiving member 6. Optionally, the axis Z is located as far as possible from the receiving member 6 so that the radius of curvature of the path of the receiving member 6 is as large as possible. This configuration may allow the receiving member 6 to execute a movement, which, over a short distance, may be a substantially linear movement. Between the two arms 31, the actuator element 30 may form a portion of a spherical surface 32 designed to engage with a bearing surface 33 formed by the dispensing head 25. Alternatively, the portion of the surface 32 may comprise, for instance, a cylindrical profile (FIG. 4A) or a conical profile (FIG. 4B). The bearing surface 33 may be substantially perpendicular to the axis Y of the dispensing head 25. Likewise, on either side of the portion of spherical surface 32, the actuator element 30 may support two flat elements 34 optionally designed to fit around the dispensing head 25 and prevent it from rotating about its axis Y, for instance, under the action of the spring that may be used to return the pump 21 to the closed position. The two flat elements 34 may translationally guide the dispensing head 25 and act as an anti-rotation device.

The device in this optional embodiment also may comprise a locking member 40 to prevent actuation of the dispensing member 21 in the absence of a product sampler to be impregnated located on the receiving member 6. Such a locking member 40 may comprise an element forming a catch 41, which in the absence of a product sampler on the receiving member 6 (as shown in FIG. 2), may be postioned alongside a free edge 42 of a skirt forming part of the dispensing head 25. When the catch 41 is in this position, the dispensing head 25 cannot be moved away from the front face 2 of the enclosure 3. The locking element 40 also may comprise a pin 43 with a free end 44 situated effectively in the bottom of the indentation 7 of the receiving member 6. The other end of the pin 43 may be near an axis X about which the locking element 40 may pivot relative to the enclosure 3. The axis X may be perpendicular to the axis A of the receiving member 6 and parallel to the axis Z about which the actuator element 30 may pivot relative to the fixed frame 3. The axis X may be approximately level with the skirt whose free end 42 abuts against the catch 41. The part of the locking element 40 that lies on the same side of the catch 41 may be heavy enough for its own weight to cause the locking element 40 to automatically resume its locked position (FIG. 2) when no force is applied to the free end 44 of the pin 43.

As shown in FIG. 2, the indentation 7 in the upper surface 14 of the receiving member 6 may end with a stop surface portion 50 designed to form an axial stop for the product sampler to be impregnated, when it is moved along the axis A.

The device described above operates as illustrated in FIGS. 3A–3C, which will now be considered.

Figure 3A:
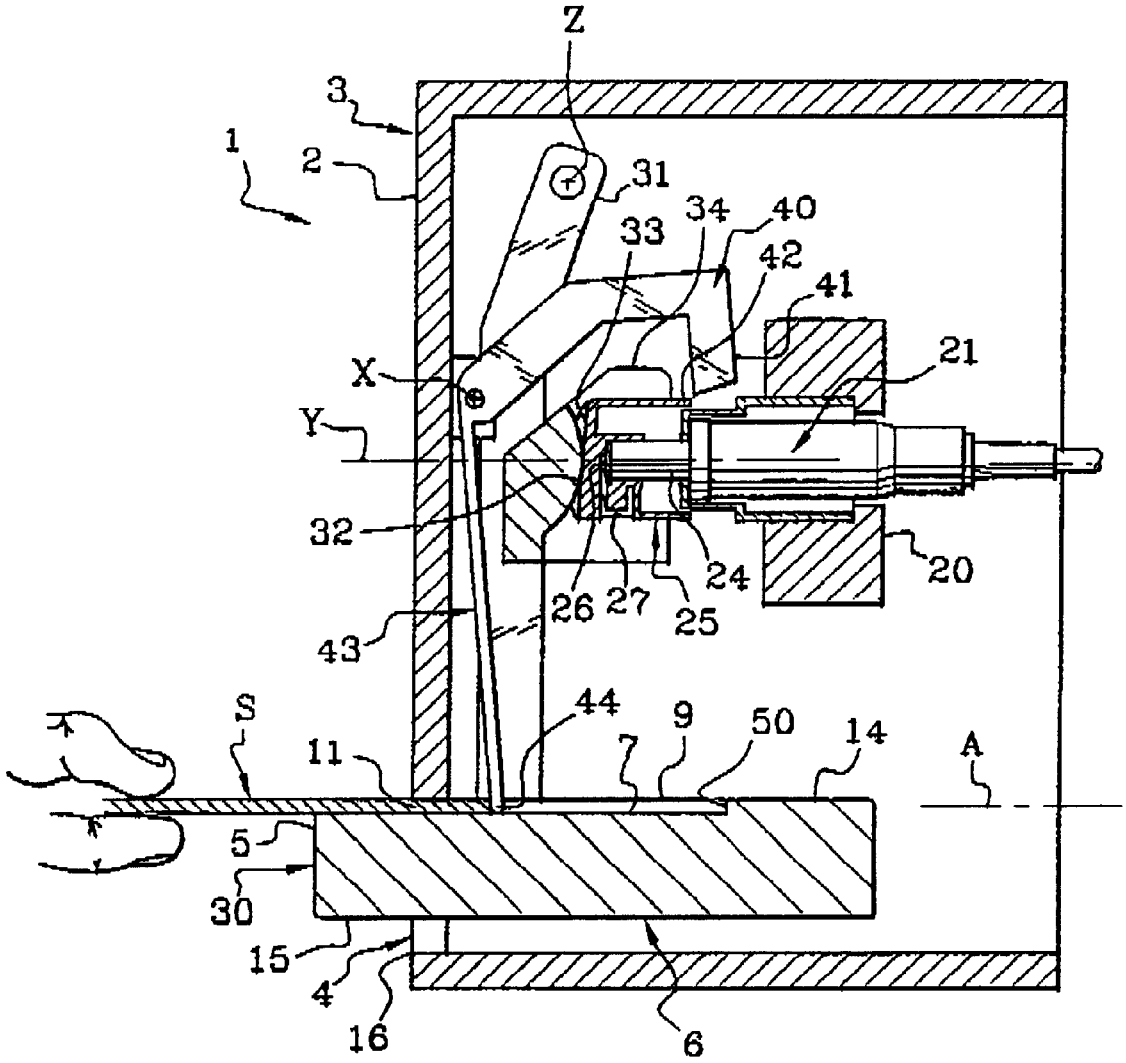
FIGS. 3A–3C illustrate three stages in the operation of the system of FIG. 2.

In FIG. 3A, the consumer holds between the thumb and index finger a product sampler S to be impregnated in the form, for example, of an approximately 2 cm wide strip of cardboard. The consumer is shown pushing the product sampler S into the slot 11 defined by the axial indentation 7 and by the top edge of the window 4. The product sampler S may be guided along the indentation 7 by the edges 8 and 9, until the forward end of the product sampler S meets the free end 44 of the pin 43. At this point, the pin pivots about the axis X, causing a corresponding pivoting of the catch 41, until the catch 41 is no longer against the skirt portion 42 of the dispensing head 25.

Figure 3B:
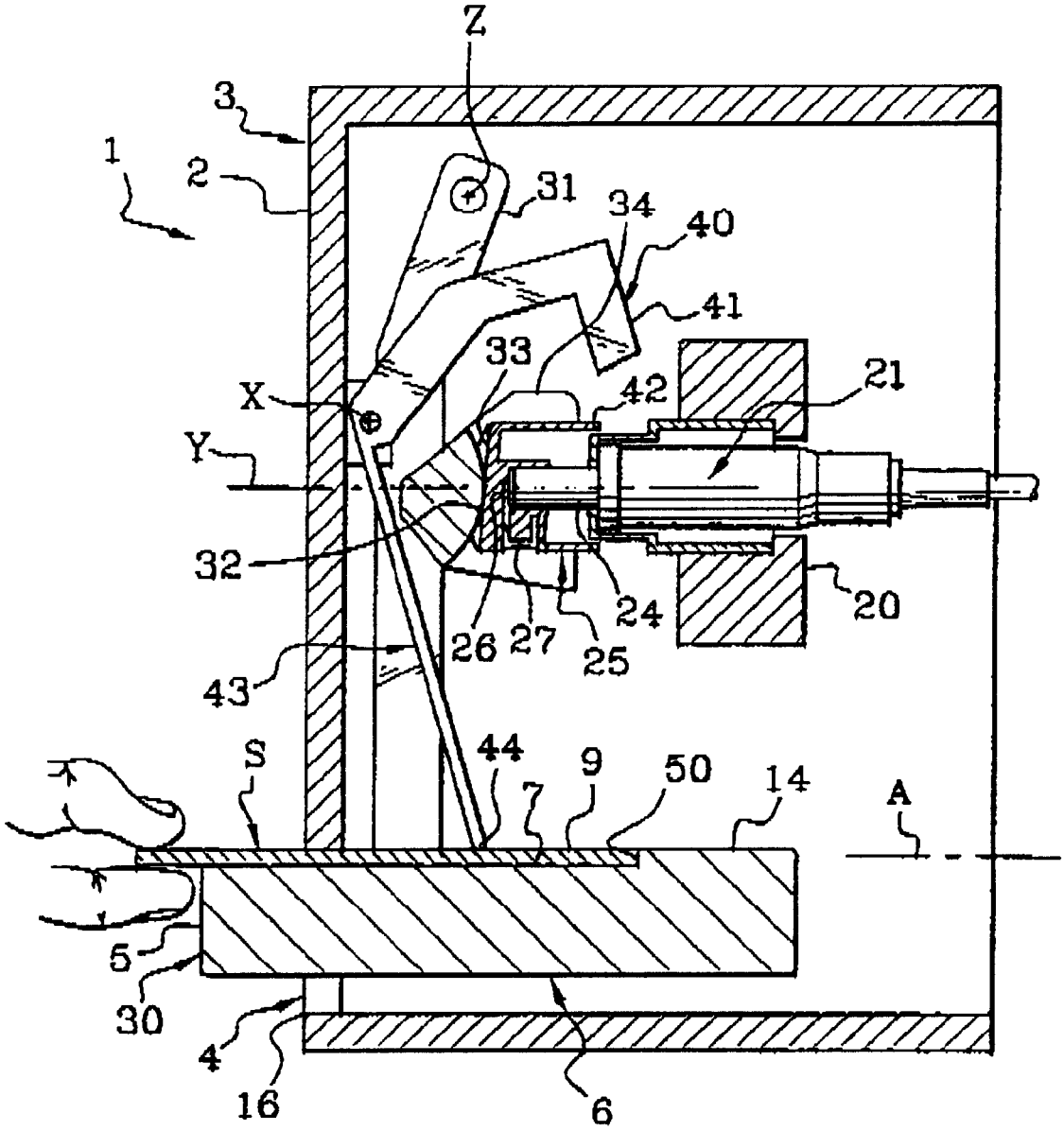

As shown in FIG. 3B, as the product sampler S continues to be advanced into the slot 11, the free end 44 of the pin 43 rises up onto the product sampler S. The product sampler S continues its axial progression or movement into the indentation 7 of the receiving member 6, until the forward end of the product sampler S reaches the stop surface 50. At this point, the consumer's fingers are approximately in contact with the front face 5 of the receiving member 6.

Figure 3C:
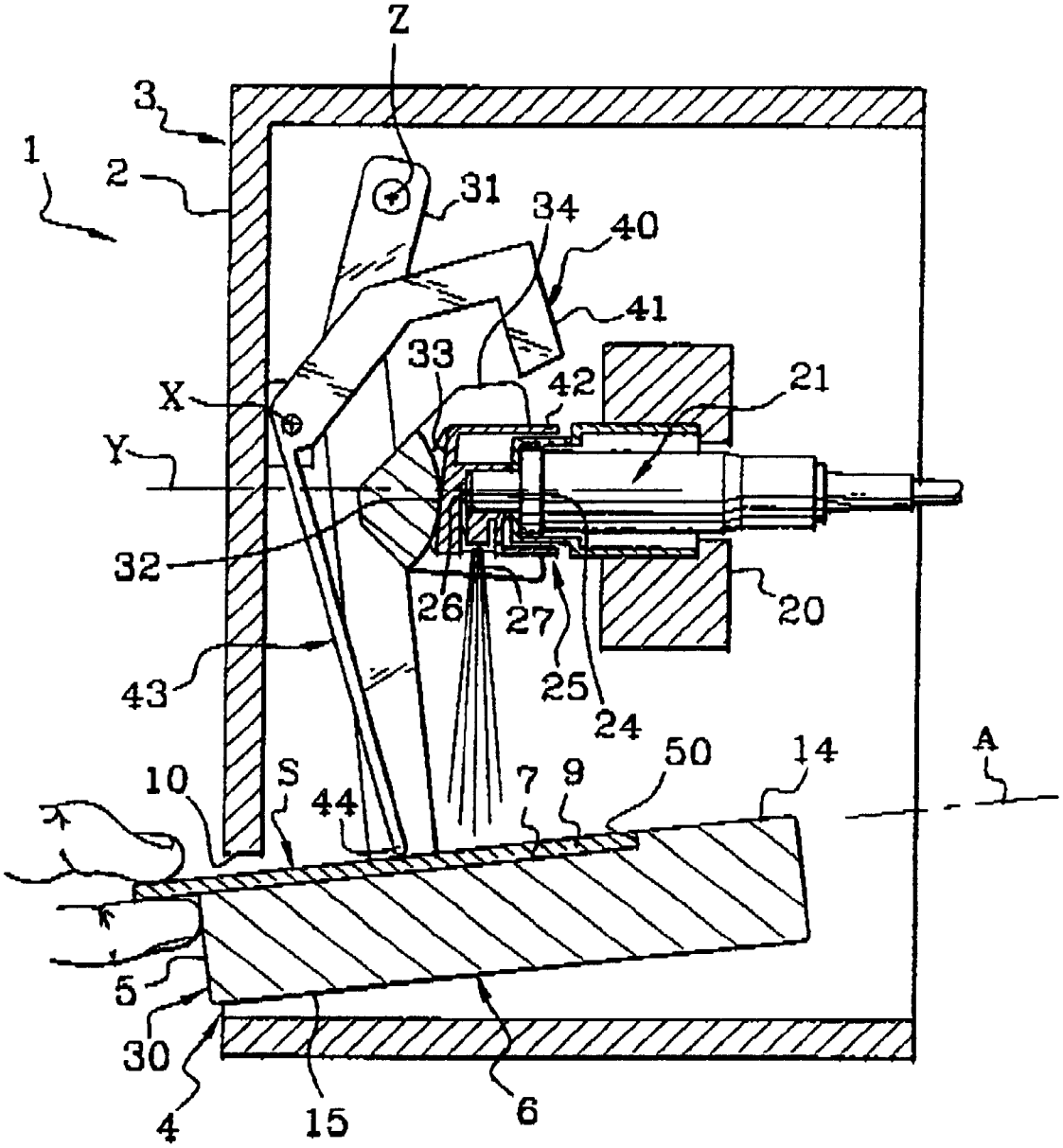

In FIG. 3C, the consumer pushes on the actuator element 30, via the front face 5 of the receiving member 6. The pressure is applied in approximately the same direction as the movement that causes the product sampler S to advance into the axial indentation 7. As it acts in this direction, the pressure causes the receiving member 6 to tilt about the pivot axis Z, and also causes the portion of spherical surface 32 of the actuator element 30 to engage with the bearing surface 33 of the dispensing head 25. The bearing surface 33 pushes the pump rod 24 axially in, and the product is released in the form of a spray through the orifice 27. In this dispensing position, the angle formed by the receiving member 6 relative to the horizontal may be about 15°. The spray released from the orifice 27 is directed at the product sampler S and impregnates it. The consumer then releases the pressure on the front face 5 of the receiving member 6, so that the latter swings back about the axis Z. She pulls the product sampler S so that it slides axially away from the stop surface 50. The product sampler quickly disengages from the free end 44 of the pin 43, causing the catch 41 to drop back under gravity into the locked position against the skirt portion 42 of the dispensing head 25. The device 1 is then ready to impregnate a new product sampler.

It will be apparent to those skilled in the art that various modifications and variations can be made to the structure and methodology described herein. Thus, it should be understood that the invention is not limited to the examples discussed in the specification. Rather, the present invention is intended to cover modifications and variations.

What is claimed is:

1. A device for dispensing a product onto a product sampler, the device comprising:

a dispensing member configured to be connected to a product receptacle;

at least one outlet orifice in flow communication with the dispensing member;

an actuator element configured to actuate the dispensing member; and a locking element having a first position in which the dispensing member cannot be actuated and a second position in which the dispensing member can be actuated, wherein the locking element is configured to move from the first position to the second position when at least a part of the product sampler is placed in front of the at least one outlet orifice.

2. The device of claim 1, further comprising a receiving member configured to receive the product sampler and to enable the placing of at least a part of the product sampler in front of the at least one outlet orifice.

3. The device of claim 2, wherein the receiving member is substantially in the form of a plate.

4. The device of claim 1, wherein the actuator element is configured to actuate the dispensing member when at least a part of the product sampler is placed in front of the at least one outlet orifice.

5. The device of claim 2, wherein the device is configured so that the at least a part of the product sampler is placed in front of the at least one outlet orifice by a movement of the product sampler with respect to the receiving member.

6. The device of claim 5, wherein the movement of the product sampler with respect to the receiving member is a substantially translational movement.

7. The device of claim 2, wherein the receiving member is a component of the actuator element.

8. The device of claim 1, wherein the actuator element is manually actuated.

9. The device of claim 5, wherein the dispensing member is actuated by a force applied to the actuator element, and wherein the force is applied approximately along an axis defined by a direction of movement of the product sampler with respect to the receiving member.

10. The device of claim 2, wherein the receiving member comprises a guide element configured to guide the product sampler during a substantially translational movement of the product sampler relative to the receiving member.

11. The device of claim 5, further comprising a stop configured to limit the movement of the product sampler with respect to the receiving member.

12. The device of claim 1, further comprising a dispensing head coupled to the dispensing member, the dispensing head comprising the at least one outlet orifice.

13. The device of claim 12, wherein the locking element comprises a catch configured to engage a portion of the dispensing head to prevent actuation of the dispensing member when the locking element is in the first position.

14. The device of claim 13, wherein the locking element comprises a pin coupled to the catch, the pin being configured to engage the product sampler when the at least a part of the product sampler is placed in front of the at least one outlet orifice.

15. The device of claim 14, wherein the locking element moves to the second position when the pin engages the product sampler.

16. The device of claim 15, wherein the catch is configured to be disengaged from the dispensing head to allow actuation of the dispensing head when the locking element is in the second position.

17. The device of claim 13, wherein the catch is configured to pivot about a first pivot axis.

18. The device of claim 17, wherein the first pivot axis is substantially perpendicular to a longitudinal axis of the dispensing member.

19. The device of claim 17, further comprising a receiving member configured to enable the placing of at least a part of the product sampler in front of the at least one outlet orifice, wherein the at least a part of the product sampler is placed in front of the at least one outlet orifice by a movement of the product sampler with respect to the receiving member, and wherein the first pivot axis is substantially perpendicular to an axis defined by a direction of movement of the product sampler with respect to the receiving member.

20. The device of claim 17, wherein the first pivot axis is approximately the same distance from a longitudinal axis of the dispensing member as the portion of the dispensing head engaged by the catch when the locking element is in the first position.

21. The device of claim 15, wherein the locking element automatically returns to the first position when the product sampler is disengaged from the pin.

22. The device of claim 21, wherein the locking element automatically returns to the first position due to gravity.

23. The device of claim 1, wherein the dispensing member comprises an actuating member, movement of the actuating member along a longitudinal axis of the dispensing member actuating the dispensing member.

24. The device of claim 23, wherein the actuating member is a pump rod.

25. The device of claim 17, wherein the actuator element is configured to pivot about a second pivot axis perpendicular to the longitudinal axis of the dispensing member.

26. The device of claim 25, wherein the second pivot axis is substantially perpendicular to an axis defined by a direction of movement of the product sampler with respect to the receiving member.

27. The device of claim 25, further comprising a dispensing head coupled to the dispensing member, wherein the dispensing head comprises the at least one outlet orifice and a bearing surface, and wherein the actuator element engages the bearing surface during the pivoting of the actuator element about the second pivot axis.

28. The device of claim 27, wherein the actuator element and the bearing surface engage one another via a portion of at least one of the actuator element and the bearing surface.

29. The device of claim 28, wherein the portion of the at least one of the actuator element and the bearing surface has one of a substantially spherical profile, a substantially cylindrical profile, and a substantially conical profile.

30. The device of claim 12, further comprising an anti-rotation element coupled to the dispensing head to substantially prevent rotation of the dispensing head about a longitudinal axis of the dispensing member.

31. A system for dispensing a product onto a product sampler, the system comprising:

the device of claim 1; and a product receptacle in flow communication with the device.

32. The system of claim 31, wherein the product receptacle contains a product.

33. The system of claim 32, wherein the product is a perfume.

34. A system for dispensing a product onto a product sampler, the system comprising:

the device of claim 1; and an enclosure for substantially containing the device.

35. The system of claim 34, wherein the enclosure comprises a passage through a wall of the enclosure configured to allow at least a part of the product sampler to be placed in front of the at least one outlet orifice.

36. The system of claim 34, wherein the actuator element is at least partially accessible from outside the enclosure.

37. The system of claim 35, wherein the actuator element comprises a receiving member configured to receive the product sampler and to enable the placing of at least part of the product sampler in front of the at least one outlet orifice, wherein the receiving member extends at least partly outside of the enclosure via the passage, and wherein the dispensing member is actuated in response to a pressure applied to the receiving member.

38. The system of claim 34, wherein the dispensing member is configured to couple to the product receptacle via a supply line, the supply line having a first end inside the enclosure and a second end outside of the enclosure, the second end being configured to be connected to the product receptacle.

39. The system of claim 38, further comprising a product receptacle containing a product.

40. A method of dispensing a product onto a product sampler, the method comprising:

providing the system of claim 32;

placing at least a part of a product sampler in front of the at least one outlet orifice; and dispensing the product onto the product sampler.

41. The method of claim 40, wherein the actuator element comprises a receiving member configured to receive the product sampler, and wherein the placing comprises using the receiving member to place at least a part of the product sampler in front of the at least one outlet orifice.

42. The method of claim 41, wherein the dispensing comprises actuating the dispensing member by moving the product sampler in front of the at least one outlet orifice.

43. The method of claim 41, wherein the dispensing comprises actuating the dispensing member by applying a force to the actuator element, the force being applied approximately along an axis defined by a direction of movement of the product sampler with respect to the receiving member.

44. The method of claim 41, further comprising guiding the product sampler with a guide element of the receiving member and stopping movement of the product sampler with respect to the receiving member when the product sampler contacts a stop of the receiving member.

45. The method of claim 40, wherein the dispensing comprising dispensing the product from a dispensing head coupled to the dispensing member, the dispensing head including the at least one outlet orifice.

46. The method of claim 40, wherein the locking element comprises a catch configured to engage a portion of the dispensing head to prevent actuation of the dispensing member when the locking element is in the first position and to be disengaged from the dispensing head to allow actuation of the dispensing member when the locking element is in the second position, and wherein the method further comprises moving the locking element from the first position to the second position.

47. The method of claim 46, wherein the locking element comprises a pin coupled to the catch, and wherein the placing of the product sampler comprises engaging the product sampler with the pin to move the locking element from the first position to the second position.

48. The method of claim 46, wherein the moving of the locking element comprises pivoting the catch about a first pivot axis, the first pivot axis being substantially perpendicular to a longitudinal axis of the dispensing member.

49. The method of claim 47, wherein the locking element automatically returns to the first position when the product sampler is disengaged from the pin, and wherein the method further comprises disengaging the product sampler from the pin.

50. The method of claim 48, further comprising pivoting the actuator element about a second pivot axis perpendicular to a longitudinal axis of the dispensing member.

51. The method of claim 50, wherein the system further comprises a dispensing head coupled to the dispensing member, the dispensing head comprising the at least one outlet orifice and a bearing surface, and wherein the method further comprises engaging the actuator element with the bearing surface during the pivoting of the actuator element about the second pivot axis.

52. The method of claim 51, further comprising preventing rotation of the dispensing head about a longitudinal axis of the dispensing member with an anti-rotation element coupled to the dispensing head.

53. The method of claim 40, wherein the dispensing of the product comprises dispensing a perfume.

54. A method for dispensing a product onto a product sampler, the method comprising:

providing the system of claim 39;

placing at least a part of the product sampler in front of the at least one outlet orifice; and dispensing the product onto the product sampler.

55. The method of claim 54, further comprising actuating the dispensing member when at least a part of the product sampler is placed in front of the outlet orifice.

56. The method of claim 54, wherein the actuator element comprises a receiving member configured to hold the product sampler, and wherein the placing of the product sampler comprises moving the product sampler with respect to a receiving member to enable the placing of at least a part of the product sampler in front of the at least one outlet orifice.

57. The method of claim 55, wherein the actuating of the dispensing member comprises applying a manual force to the actuator element.

58. The method of claim 57, wherein the manual force is applied approximately along an axis defined by a direction of movement of the product sampler with respect to the receiving member.

59. The method of claim 55, further comprising guiding the product sampler with a guide element of the receiving member and stopping movement of the product sampler with respect to the receiving member when the product sampler contacts a stop of the receiving member.

60. The method of claim 54, wherein the locking element comprises a catch configured to engage a portion of the dispensing head to prevent actuation of the dispensing member when the locking element is in the first position and to be disengaged from the dispensing head to allow actuation of the dispensing member when the locking element is in the second position, and wherein the method further comprises moving the locking element from the first position to the second position.

61. The method of claim 60, wherein the locking element comprises a pin coupled to the catch, and wherein the placing of the product sampler comprises engaging the product sampler with the pin to move the locking element from the first position to the second position.

62. The method of claim 60, wherein the moving of the locking element comprises pivoting the catch about a first pivot axis, the first pivot axis being substantially perpendicular to a longitudinal axis of the dispensing member.

63. The method of claim 61, wherein the locking element automatically returns to the first position when the product sampler is disengaged from the pin, and wherein the method further comprises disengaging the product sampler from the pin.

64. The method of claim 61, wherein the moving of the locking element from the first position to the second position comprises pivoting the actuator element about a second pivot axis perpendicular to a longitudinal axis of the dispensing member.

65. The method of claim 64, wherein the dispensing head comprises a bearing surface, and wherein the pivoting of the actuator element about the second pivot axis comprises engaging the actuator element with the bearing surface.

66. A device for dispensing a product onto a product sampler, the device comprising:

a dispensing member capable of being actuated and configured to be connected to a product receptacle;

a dispensing head movably coupled to the dispensing member and having at least one outlet orifice;

an actuator element configured to engage the dispensing head; and a locking element having a first position engaged with the dispensing head and having a second position disengaged from the dispensing head;

wherein the dispensing member cannot be actuated with the locking element in the first position and the dispensing member can be actuated with the locking element in the second position, and wherein the locking element is configured to move from the first position to the second position when the product sampler is moved relative to the dispensing member.

67. The device of claim 66, wherein movement of the dispensing head relative to the dispensing member actuates the dispensing member, and wherein the actuator element is configured to move the dispensing head relative to the dispensing member.

68. The device of claim 66, further comprising a receiving member configured to receive the product sampler and to enable at least a part of the product sampler to be placed in front of the at least one outlet orifice.

69. The device of claim 66, wherein the actuator element is configured to actuate the dispensing member when at least a part of the product sampler is placed in front of the outlet orifice.

70. The device of claim 68, wherein the device is configured so that the product sampler is placed in front of the at least one outlet orifice by a movement of the product sampler with respect to the receiving member.

71. The device of claim 68, wherein the dispensing member is actuated by a force applied to the actuator element, and wherein the force is applied approximately along an axis defined by a direction of movement of the product sampler with respect to the receiving member.

72. The device of claim 68, wherein the receiving member comprises a guide element configured to guide the product sampler during a substantially translational movement of the product sampler relative to the receiving member.

73. The device of claim 68, further comprising a stop configured to limit the movement of the product sampler with respect to the receiving member.

74. The device of claim 70, wherein the locking element comprises a catch configured to engage a portion of the dispensing head to prevent actuation of the dispensing member when the locking element is in the first position.

75. The device of claim 74, wherein the locking element comprises a pin coupled to the catch, the pin being configured to engage the product sampler when the product sampler is placed in front of the at least one outlet orifice.

76. The device of claim 75, wherein the locking element moves to the second position when the pin engages the product sampler.

77. The device of claim 75, wherein the catch is configured to be disengaged from the dispensing head to allow actuation of the dispensing member when the locking element is in the second position.

78. The device of claim 75, wherein the catch is configured to pivot about a first pivot axis.

79. The device of claim 76, wherein the locking element automatically returns to the first position when the product sampler is disengaged from the pin.

80. The device of claim 66, wherein the dispensing member comprises an actuating member, movement of the actuating member along a longitudinal axis of the dispensing member actuating the dispensing member.

81. The device of claim 78, wherein the actuator element is configured to pivot about a second pivot axis perpendicular to the longitudinal axis of the dispensing member.

82. The device of claim 81, wherein the dispensing head comprises a bearing surface, and wherein the actuator element engages the bearing surface when the actuator element is pivoted about the second pivot axis.

83. The device of claim 66, further comprising an anti-rotation element coupled to the dispensing head to substantially prevent rotation of the dispensing head about a longitudinal axis of the dispensing member.

84. A system for dispensing a product onto a product sampler, the system comprising:

the device of claim 66; and a product receptacle in flow communication with the device.

85. The system of claim 84, wherein the product receptacle contains a product.

86. A system for dispensing a product onto a product sampler, the system comprising:

the device of claim 66; and an enclosure for substantially containing the device.

87. The system of claim 86, wherein the enclosure comprises a passage through a wall of the enclosure configured to allow at least a part of the product sampler to be placed in front of the at least one outlet orifice.

88. The system of claim 86, wherein the actuator element is at least partially accessible from outside the enclosure.

89. The system of claim 87, wherein the actuator element comprises a receiving member configured to receive the product sampler and to enable the placing of at least part of the product sampler in front of the at least one orifice, wherein the receiving member extends at least partly outside of the enclosure via the passage, and wherein the dispensing member is actuated in response to a pressure applied to the receiving member.

90. The system of claim 86, wherein the dispensing member is configured to couple to the product receptacle via a supply line, the supply line having a first end inside the enclosure and a second end outside of the enclosure, the second end being configured to be connected to the product receptacle.

91. The system of claim 90, further comprising a product receptacle, wherein the product receptacle contains a perfume.

92. A method for dispensing a product onto a product sampler, the method comprising:

placing at least a part of the product sampler in front of the at least one outlet orifice of the system of claim 86; and dispensing the product onto the product sampler.

93. The method of claim 92, further comprising actuating the dispensing member when at least a part of the product sampler is placed in front of the outlet orifice.

94. The method of claim 92, wherein the actuator element comprises a receiving member configured to hold the product sampler, and wherein the placing of the product sampler comprises moving the product sampler with respect to a receiving member to enable the placing of at least a part of the product sampler in front of the at least one outlet orifice.

95. The method of claim 93, wherein the actuating of the dispensing member comprises applying a manual force to the actuator element.

96. The method of claim 95, wherein the manual force is applied approximately along an axis defined by a direction of movement of the product sampler with respect to the receiving member.

97. The method of claim 93, further comprising guiding the product sampler with a guide element of the receiving member and stopping movement of the product sampler with respect to the receiving member when the product sampler contacts a stop of the receiving member.

98. The method of claim 92, wherein the locking element comprises a catch configured to engage a portion of the dispensing head to prevent actuation of the dispensing member when the locking element is in the first position and to be disengaged from the dispensing head to allow actuation of the dispensing member when the locking element is in the second position, and wherein the method further comprises moving the locking element from the first position to the second position.

99. The method of claim 98, wherein the locking element comprises a pin coupled to the catch, and wherein the placing of the product sampler comprises engaging the product sampler with the pin to move the locking element from the first position to the second position.

100. The method of claim 98, wherein the moving of the locking element comprises pivoting the catch about a first pivot axis, the first pivot axis being substantially perpendicular to a longitudinal axis of the dispensing member.

101. The method of claim 99, wherein the locking element automatically returns to the first position when the product sampler is disengaged from the pin, and wherein the method further comprises disengaging the product sampler from the pin.

102. The method of claim 99, wherein the moving of the locking element from the first position to the second position comprises pivoting the actuator element about a second pivot axis perpendicular to a longitudinal axis of the dispensing member.

103. The method of claim 102, wherein the dispensing head comprises a bearing surface, and wherein the pivoting of the actuator element about the second pivot axis comprises engaging the actuator element with the bearing surface.

104. The system of claim 85, wherein the product is a perfume.

105. The system of claim 39, wherein the product is a perfume.

106. The device of claim 1, wherein the locking element is configured to move from the first position to the second position in response to movement of the product sampler.

107. The device of claim 66, wherein the locking element is configured to move from the first position to the second position in response to movement of the product sampler.

* * * * *